US010125318B2

(12) United States Patent
Koseoglu

(10) Patent No.: US 10,125,318 B2
(45) Date of Patent: Nov. 13, 2018

(54) PROCESS FOR PRODUCING HIGH QUALITY COKE IN DELAYED COKER UTILIZING MIXED SOLVENT DEASPHALTING

(71) Applicant: Saudi Arabian Oil Company, Shahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 85 days.

(21) Appl. No.: 15/491,560

(22) Filed: Apr. 19, 2017

(65) Prior Publication Data

US 2017/0306240 A1 Oct. 26, 2017

Related U.S. Application Data

(60) Provisional application No. 62/327,661, filed on Apr. 26, 2016.

(51) Int. Cl.

| | |
|---|---|
| ***C10B 57/04*** | (2006.01) |
| ***C10G 21/00*** | (2006.01) |
| ***C10G 67/04*** | (2006.01) |
| ***C10G 55/04*** | (2006.01) |
| ***C10B 55/00*** | (2006.01) |
| ***C10G 21/14*** | (2006.01) |

(52) U.S. Cl.

CPC ..... *C10B 57/045* (2013.01); *C10B 55/00* (2013.01); *C10G 21/003* (2013.01); *C10G 21/14* (2013.01); *C10G 55/04* (2013.01); *C10G 67/0454* (2013.01); *C10G 67/0463* (2013.01)

(58) Field of Classification Search

CPC ..... C10B 57/045

See application file for complete search history.

(56) References Cited

U.S. PATENT DOCUMENTS

| | | | |
|---|---|---|---|
| 2,188,051 | A | 1/1940 | Lantz |
| 4,006,076 | A | 2/1977 | Christensen et al. |
| 4,054,512 | A | 10/1977 | Dugan et al. |
| 4,125,459 | A | 11/1978 | Garwin |
| 4,324,651 | A | 4/1982 | Rollmann et al. |
| 4,338,183 | A | 7/1982 | Gatsis |
| 4,405,445 | A | 9/1983 | Kovach et al. |
| 4,686,028 | A | 8/1987 | Van Driesen et al. |
| 5,192,421 | A | 3/1993 | Audeh et al. |
| 5,244,565 | A | 9/1993 | Lankton et al. |
| 5,258,117 | A | 11/1993 | Kolstad et al. |
| 5,286,371 | A | 2/1994 | Goval et al. |
| 5,302,282 | A | 4/1994 | Kalnes et al. |
| 5,324,417 | A | 7/1994 | Harandi |
| 5,976,361 | A | 11/1999 | Hood et al. |
| 6,274,032 | B2 | 8/2001 | Hood et al. |
| 6,332,975 | B1 | 12/2001 | Abdel-Halim et al. |
| 7,297,250 | B2 | 11/2007 | Bronicki |
| 7,566,394 | B2 | 7/2009 | Koseoglu |
| 7,622,035 | B2 | 11/2009 | Zaki et al. |
| 7,744,743 | B2 | 6/2010 | McCoy et al. |
| 7,790,018 | B2 | 9/2010 | Khan |
| 7,799,211 | B2 | 9/2010 | Koseoglu et al. |
| 7,955,403 | B2 | 6/2011 | Ariyapadi et al. |
| 7,955,496 | B2 | 6/2011 | Iqbal et al. |
| 7,964,090 | B2 | 6/2011 | Iqbal |
| 7,981,277 | B2 | 7/2011 | Subramanian et al. |
| 8,382,867 | B2 | 2/2013 | Ariyapadi et al. |
| 8,608,942 | B2 | 12/2013 | Subramanian et al. |
| 8,696,888 | B2 | 4/2014 | Keusenkothen et al. |
| 8,709,233 | B2 | 4/2014 | McCoy et al. |
| 8,728,300 | B2 | 5/2014 | Iqbal et al. |
| 8,790,508 | B2 | 7/2014 | Koseoglu et al. |
| 8,852,426 | B2 | 10/2014 | Koseoglu |
| 8,882,991 | B2 | 11/2014 | Kuechler et al. |
| 9,023,192 | B2 | 5/2015 | Koseoglu |
| 2001/0002654 | A1 | 6/2001 | Hood et al. |
| 2002/0112986 | A1 | 8/2002 | Li et al. |
| 2003/0129109 | A1 | 7/2003 | Bronicki |
| 2006/0032789 | A1 | 2/2006 | Bronicki |
| 2006/0254956 | A1 | 11/2006 | Khan |
| 2007/0090018 | A1 | 4/2007 | Keusenkothen et al. |
| 2008/0099371 | A1 | 5/2008 | McCoy et al. |
| 2008/0116109 | A1 | 5/2008 | McCoy et al. |
| 2008/0223574 | A1 | 9/2008 | Subramanian et al. |
| 2009/0120842 | A1 | 5/2009 | Koseoglu et al. |
| 2009/0166266 | A1 | 7/2009 | Subramanian et al. |
| 2009/0261017 | A1 | 10/2009 | Iqbal et al. |
| 2009/0294328 | A1 | 12/2009 | Iqbal |
| 2009/0301931 | A1 | 12/2009 | Koseoglu et al. |
| 2010/0011664 | A1 | 1/2010 | Ariyapadi et al. |
| 2010/0132257 | A1 | 6/2010 | Agrawal et al. |
| 2010/0147647 | A1 | 6/2010 | Koseoglu et al. |
| 2011/0042269 | A1 | 2/2011 | Kuechler et al. |
| 2011/0094937 | A1 | 4/2011 | Subramanian et al. |
| 2011/0215030 | A1 | 9/2011 | Corscadden |
| 2011/0226666 | A1 | 9/2011 | Koseoglu et al. |

FOREIGN PATENT DOCUMENTS

| | | | |
|---|---|---|---|
| EP | 0099141 | A1 | 1/1984 |
| EP | 2947133 | A1 | 11/2015 |

(Continued)

OTHER PUBLICATIONS

International Search Report and Written Opinion pertaining to PCT/US2017/028567 dated Jun. 29, 2017.

(Continued)

*Primary Examiner* — Stuart L Hendrickson

(74) *Attorney, Agent, or Firm* — Dinsmore & Shohl LLP

(57) ABSTRACT

Process embodiments for producing green coke from residual oil comprise introducing residual oil and a solvent mixture into a mixing vessel to produce a feed mixture, the solvent mixture comprising at least one paraffinic solvent with a carbon number from 3 to 8 and at least one aromatic solvent, where the solvent mixture comprises from 0.1 to 10% by volume of aromatic solvent and 90 to 99.9% by volume of paraffinic solvent, passing the feed mixture to a solvent deasphalting unit to produce a deasphalted oil (DAO) fraction and an asphalt fraction, and passing the DAO fraction to a delayed coker to produce the green coke and a delayed coker effluent.

20 Claims, 4 Drawing Sheets

(56) References Cited

U.S. PATENT DOCUMENTS

| | | | |
|---|---|---|---|
| 2012/0074040 | A1 | 3/2012 | Koseoglu et al. |
| 2012/0091032 | A1 | 4/2012 | Iqbal et al. |
| 2012/0101323 | A1 | 4/2012 | Ariyapadi et al. |
| 2012/0298552 | A1 | 11/2012 | Koseoglu |
| 2013/0026064 | A1 | 1/2013 | Koseoglu |
| 2013/0026067 | A1 | 1/2013 | Koseoglu |
| 2013/0026069 | A1 | 1/2013 | Koseoglu |
| 2013/0026074 | A1 | 1/2013 | Koseoglu et al. |
| 2013/0026075 | A1 | 1/2013 | Koseoglu et al. |
| 2013/0047509 | A1 | 2/2013 | Ariyapadi et al. |
| 2013/0055637 | A1 | 3/2013 | Ariyapadi et al. |
| 2013/0062255 | A1 | 3/2013 | Koseoglu |
| 2013/0062257 | A1 | 3/2013 | Koseoglu |
| 2013/0081325 | A1 | 4/2013 | Corscadden et al. |
| 2013/0081977 | A1 | 4/2013 | Woo et al. |
| 2013/0126395 | A1 | 5/2013 | Koseoglu et al. |
| 2013/0161236 | A1 | 6/2013 | Strauss et al. |
| 2013/0161237 | A1 | 6/2013 | Woo et al. |
| 2013/0180888 | A1 | 7/2013 | Corscadden et al. |
| 2013/0197284 | A1 | 8/2013 | Bourane et al. |
| 2013/0197289 | A1 | 8/2013 | Bourane et al. |
| 2013/0213857 | A1 | 8/2013 | Bisht et al. |
| 2013/0220884 | A1 | 8/2013 | Bourane et al. |
| 2013/0228496 | A1 | 9/2013 | Bourane et al. |
| 2013/0233768 | A1 | 9/2013 | Bourane et al. |
| 2013/0240407 | A1 | 9/2013 | Gillis |
| 2013/0292299 | A1 | 11/2013 | Koseoglu et al. |
| 2013/0315793 | A1 | 11/2013 | Koseoglu et al. |
| 2013/0319910 | A1 | 12/2013 | Koseoglu et al. |
| 2013/0334103 | A1 | 12/2013 | Bourane et al. |
| 2014/0117287 | A1 | 5/2014 | Ariyapadi et al. |
| 2014/0275672 | A1 | 9/2014 | Krishnamurthy et al. |
| 2014/0305840 | A1 | 10/2014 | Koseoglu et al. |

FOREIGN PATENT DOCUMENTS

| | | | |
|---|---|---|---|
| WO | 2014096592 | A1 | 6/2014 |
| WO | 2016015045 | A1 | 1/2016 |

OTHER PUBLICATIONS

International Search Report and Written Opinion pertaining to PCT/US2017/028710 dated Jun. 30, 2017.

PROCESS FOR PRODUCING HIGH QUALITY COKE IN DELAYED COKER UTILIZING MIXED SOLVENT DEASPHALTING

CROSS-REFERENCE TO RELATED APPLICATIONS

This application claims the benefit of U.S. Provisional Application Ser. No. 62/327,661 filed Apr. 26, 2016, incorporated herein by reference.

TECHNICAL FIELD

Embodiments of the present disclosure generally relates to processes for producing high quality coke, and more specifically relates to processes for producing high quality coke using mixed solvent deasphalting.

BACKGROUND

Coke, specifically, high quality coke is utilized in various industrial applications. For example, high quality coke such as anode grade coke may be used in the aluminum industry and needle grade coke may be used in the steel industry. Coking units are conventional oil refinery processing units that convert low value residual oil, from the vacuum distillation column or the atmospheric distillation column into low molecular weight hydrocarbon gases, naphtha, light and heavy gas oils, and petroleum coke. The most commonly used coking unit is a delayed coker. In a basic delayed coking process, fresh feedstock is introduced into the lower part of a fractionator. The fractionator bottoms, which include heavy recycle material and fresh feedstock, are passed to a furnace and heated to a coking temperature. The hot feed then goes to a coke drum maintained at coking conditions where the feed is cracked to form light products while heavy free radical molecules form heavier polynuclear aromatic compounds, which are referred to as "coke." With a short residence time in the furnace, coking of the feed is thereby "delayed" until it is discharged into a coking drum. The volatile components are recovered as coker vapor and returned to the fractionator, and coke is deposited on the interior of the drum. When the coke drum is full of coke, the feed is switched to another drum and the full drum is cooled and emptied by conventional methods, such as by hydraulic means or by mechanical means.

That being said, residual oil is known to have a significant amount of asphalt and other impurities which decreases the yield of high quality coke. Thus, conventional approaches use upstream high severity hydrotreating and hydrocracking to purify the residual oil, such that the purified residual oil may be converted into high quality coke precursor, also called green coke, in the delayed coker. For example, high severity hydrotreating process may operate at hydrogen partial pressures greater than 150 bars. The green coke produced in the delayed coker may then be calcined to produce anode coke or needle coke. While the hydrotreating upstream of the delayed coker yields green coke, it is very expensive due to its high pressure requirement.

SUMMARY

Accordingly, ongoing needs exist for improved methods and systems for producing high quality coke.

Embodiments of the present disclosure are directed to producing high quality coke using a mixed solvent deasphalting upstream of a delayed coker. In addition to producing high quality coke, replacing the high severity hydrotreating and hydrocracking processes with mixed solvent deasphalting, or with mixed solvent deasphalting and low severity hydrotreating significantly reduces the costs for producing high quality coke.

In one embodiment, a process for producing green coke from residual oil is provided. The process comprises introducing residual oil and a solvent mixture into a mixing vessel to produce a feed mixture, the solvent mixture comprising at least one paraffinic solvent with a carbon number from 3 to 8 and at least one aromatic solvent, where the solvent mixture comprises from 0.1 to 10% by volume of aromatic solvent and 90 to 99.9% by volume of paraffinic solvent, passing the feed mixture to a solvent deasphalting unit to produce a deasphalted oil (DAO) fraction and an asphalt fraction, and passing the DAO fraction to a delayed coker to produce the green coke and a delayed coker effluent.

In another process for producing green coke from residual oil, the process comprises introducing residual oil and a solvent mixture into a mixing vessel to produce a feed mixture, the solvent mixture comprising at least one paraffinic solvent with a carbon number from 3 to 8 and at least one aromatic solvent, passing the feed mixture to a solvent deasphalting unit to produce a deasphalted oil (DAO) fraction and an asphalt fraction, passing the DAO fraction to a hydrotreater unit to produce a hydrotreated DAO fraction, and passing the hydrotreated DAO fraction to a delayed coker to produce the high quality coke and a delayed coker effluent.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

Figure 1:
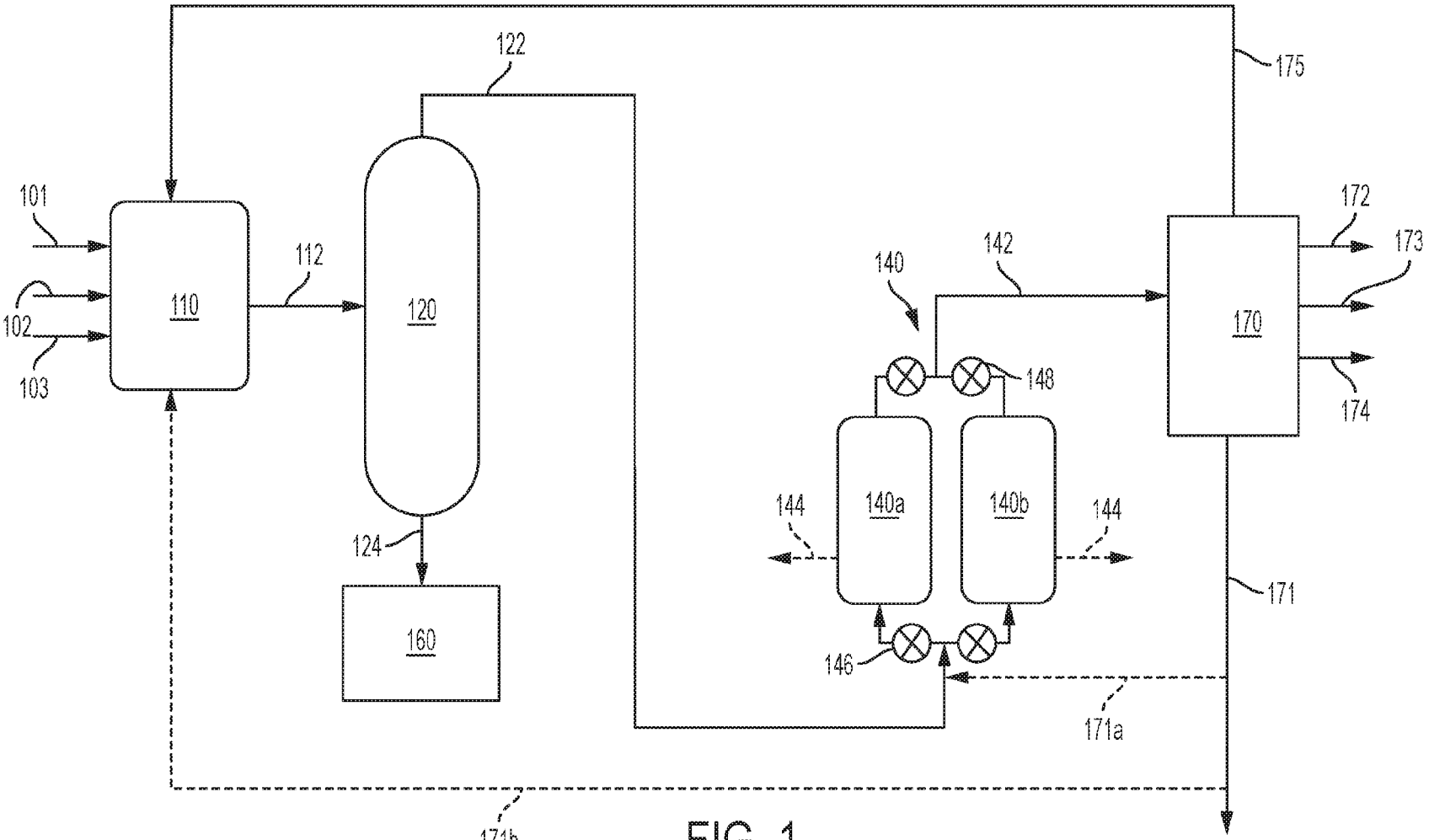
FIG. 1 is a schematic depiction of a solvent deasphalting unit with mixed solvent feed upstream of a delayed coker in accordance with one or more embodiments of the present disclosure.

The embodiments set forth in the drawings are illustrative in nature and not intended to be limiting to the claims. Moreover, individual features of the drawings will be more fully apparent and understood in view of the detailed description.

DETAILED DESCRIPTION

Embodiments of the present disclosure are directed to a process for producing high quality coke from residual oil.

As used in the application, "residual oil" refers to the product of vacuum distillation or atmospheric distillation obtained in oil refineries. Atmospheric residue is defined as hydrocarbons boiling at a temperature of at least 350° C. and vacuum residue is defined as hydrocarbons boiling at a temperature of at least 450° C.

As used in the application, "anode coke", "fuel coke", and "needle coke" are defined by the ranges and properties provided in the following Table 1. Fuel grade coke, which generally has greater than 3.5 weight (wt) % of sulfur, and anode coke, which generally has less than 3.5 weight wt % sulfur, are often distinguished based on the sulfur content in the respective cokes.

TABLE 1

| Property | Units | Fuel Coke | Calcined High quality Coke (Anode Coke) | Calcined Needle Coke |
|---|---|---|---|---|
| Bulk Density | Kilograms per cubic meter ($Kg/m^3$) | 880 | 720-800 | 670-720 |
| Sulfur | wt % | 3.5-7.5 | 1.0-3.5 | 0.2-0.5 |
| Nitrogen | Parts per million by weight (Ppmw) | 6,000 | — | 50 |
| Nickel | Ppmw | 500 | 200 | 7 max |
| Vanadium | Ppmw | 150 | 350 | — |
| Volatile Combustible Material | wt % | 12 | 0.5 | 0.5 |
| Ash Content | wt % | 0.35 | 0.40 | 0.1 |
| Moisture Content | | 8-12 | 0.3 | 0.1 |
| Hardgrove Grindability Index (HGI) | wt % | 35-70 | 60-100 | — |
| Coefficient of thermal expansion, E + 7 | ° C. | — | — | 1-5 |

Referring to the embodiments depicted in FIGS. 1-4, residual oil 101 and a solvent mixture is added to a mixing vessel 110 to produce a feed mixture 112. The solvent mixture comprises at least one paraffinic solvent 102 with a carbon number from 3 to 8 and at least one aromatic solvent 103. As shown in FIGS. 1-4, the paraffinic solvent 102 and aromatic solvent 103 are delivered as separate feeds to the mixing vessel 110; however, it is contemplated that the paraffinic solvent 102 and aromatic solvent 103 could be mixed prior to passing to the mixing vessel 110. In one embodiment, the solvent mixture comprises from 0.1 to 10% by volume of aromatic solvent and 90 to 99.9% by volume of paraffinic solvent. In another embodiment, the solvent mixture comprises from 3 to 5% by volume of aromatic solvent and 95 to 97% by volume of paraffinic solvent.

Paraffinic solvents precipitate and separate asphalt from oil solutions to produce demetallized or deasphalted oil. Deasphalted oil yield increases with increasing carbon number of the solvent; however, the quality of the deasphalted oil may decrease. Aromatics dissolve more oil and asphalts and as a result more oil may be recovered in the solvent deasphalting step at a cost of deasphalted oil quality. Without being bound by theory, it was found that changing the percentage of the aromatic solvent may impact the quality of the coke that is produced in the coking process in the delayed coker. By using up to 10% by volume of aromatic solvent, from 0.1 to 5% by volume of aromatic solvent, or from 3 to 5% by volume of aromatic solvent, the present embodiments increase deasphalted oil yield while maintaining the quality of the deasphalted oil at sufficient levels for the production of high quality coke.

Referring again to FIGS. 1-4, the feed mixture 112 is passed to a solvent deasphalting unit 120 to produce a deasphalted oil (DAO) fraction 122 and an asphalt fraction 124. As shown in FIG. 1, the DAO fraction 122 may be passed to a delayed coker 140 to produce green coke 144 and a delayed coker effluent 142

Various aromatic and paraffinic solvents are contemplated for use in the solvent mixture. Solvents can be selected based on their Hildebrand solubility parameters or on the basis of two-dimensional solubility factors. The overall Hildebrand solubility parameter is a well-known measure of polarity and has been tabulated for numerous compounds. (See, for example, Journal of Paint Technology, Vol. 39, No. 505, February 1967). The solvents can also be described by two-dimensional solubility parameters, i.e., the complexing solubility parameter and the field force solubility parameter. (See, for example, I. A. Wiehe, Ind. & Eng. Res., 34(1995), 661). The complexing solubility parameter component, which describes the hydrogen bonding and electron donor-acceptor interactions, measures the interaction energy that requires a specific orientation between an atom of one molecule and a second atom of a different molecule. The field force solubility parameter, which describes van der Waal's and dipole interactions, measures the interaction energy of the liquid that is not affected by changes in the orientation of the molecules.

As defined in the application, a polar solvent is a solvent having an overall Hildebrand solubility parameter greater than about 8.5 or a complexing solubility parameter of greater than one and a field force parameter value greater than 8. Examples of polar solvents suitable in the present solvent mixture include aromatic solvents, such as single ring aromatic compounds including toluene (8.91), benzene (9.15), and xylene (8.85). Thus, the solvent mixture may comprise a mixture of polar aromatic solvents and nonpolar paraffinic solvents. In one or more embodiments, the paraffinic solvent may comprise $C_3$-$C_{12}$ paraffins, which are solvents having a carbon number from 3 to 12. In further embodiments, the paraffinic solvent may comprises $C_3$-$C_8$ paraffins. Optionally, the solvent mixture comprises at least one olefinic solvent Like the paraffinic solvent, the olefinic solvent may also have a carbon number in the range of 3 to 8.

Referring again to FIGS. 1-4, various processing parameters are considered suitable for the operation of the solvent deasphalting unit 120. The solvent deasphalting unit 120 operates at a temperature and pressure less than the supercritical temperature and pressure, respectively, of the solvent mixture. In one or more embodiments, the solvent deasphalting unit may operate at a temperature from 50 to 400° C., or from 60 to 300° C., or from 60 to 200° C., or at approximately 70° C. Similarly, in one or more embodiments, the solvent deasphalting unit 120 may operate at a pressure from 20 to 80 bars, or from 30 to 60 bars, or at 40 bars. Additionally, the yield of deasphalted oil fraction and asphalt fraction may be adjusted by varying the ratio of the paraffinic solvent to the residual oil. In one or more embodiments, the ratio by weight of the paraffinic solvent to the residual oil is from 0.1 to 20, or from 5 to 10, or from 6 to 8. Moreover, the ratio of the solvent mixture (paraffinic plus aromatic solvents) to residual oil is from 0.1:1 to 10:1 by volume, or from 2:1 to 10:1 by volume.

Figure 3:
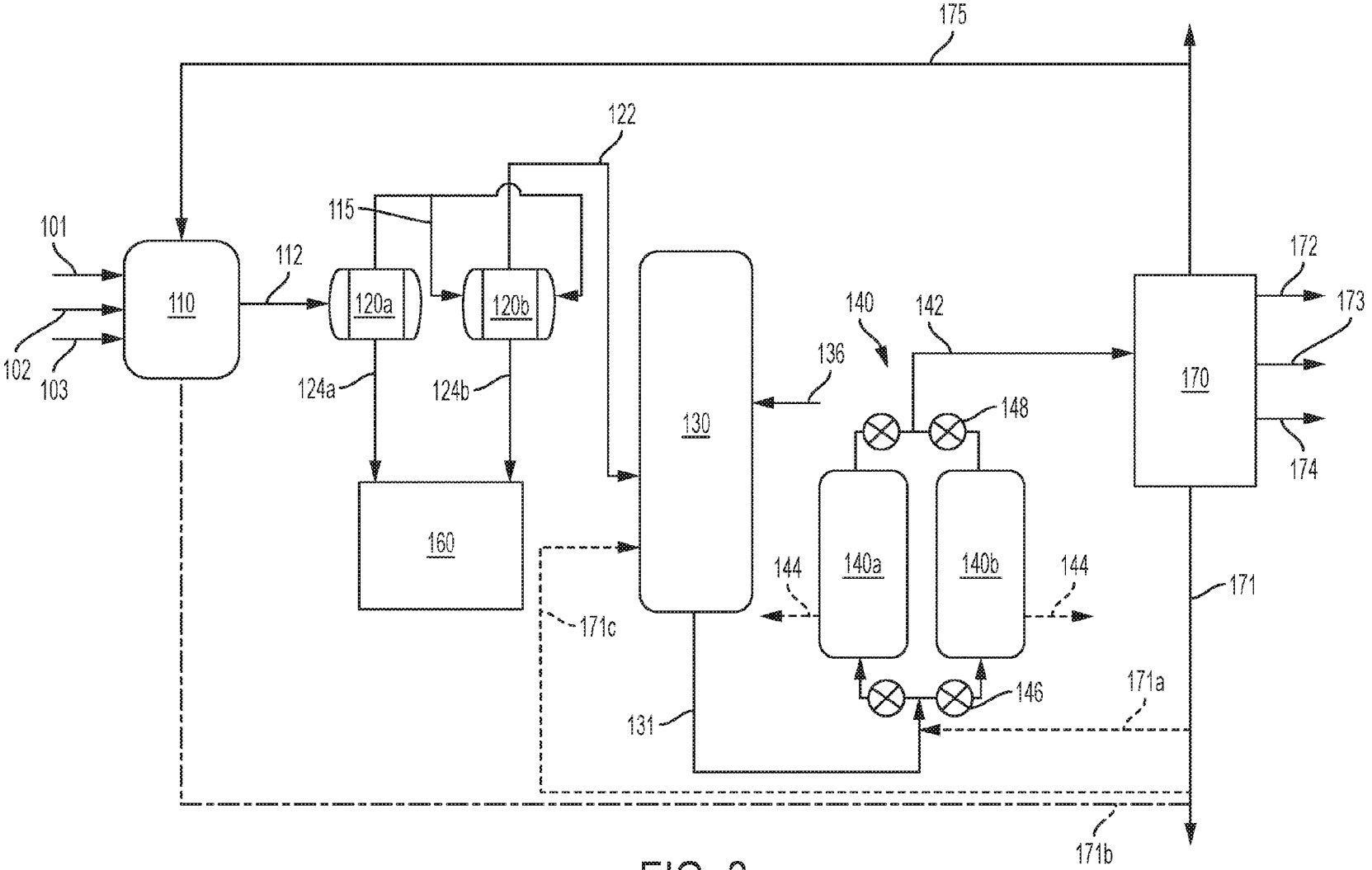
FIG. 3 is another schematic depiction of solvent deasphalting unit with mixed solvent feed upstream of a hydrotreater and delayed coker in accordance with one or more embodiments of the present disclosure.

While the present application is not limited to specific reactor systems for the solvent deasphalting unit, FIG. 3 depicts one possible example of a solvent deasphalting unit 120 comprising a primary settler tank 120*a* and a secondary settler tank 120*b*. Primary settler tank 120*a* includes an inlet for receiving feed mixture 112 and an outlet for discharging an intermediate DAO fraction 115 and several outlets for discharging a first asphalt fraction 124*a*, including a solid adsorbent, if used. Secondary settler tank 120*b* may receive the intermediate DAO fraction 115 optionally at multiple ends as shown, and may output the DAO stream 122 and a second asphalt fraction 124*b*. The first asphalt fraction 124*a* and the second asphalt fraction 124*b* may undergo further asphalt utilization and conversion steps as depicted by item 160. For example and not by way of limitation, the asphalt utilization and conversion steps includes include gasification, delivery to an asphalt pool, pyrolysis, or combinations thereof.

Figure 4:
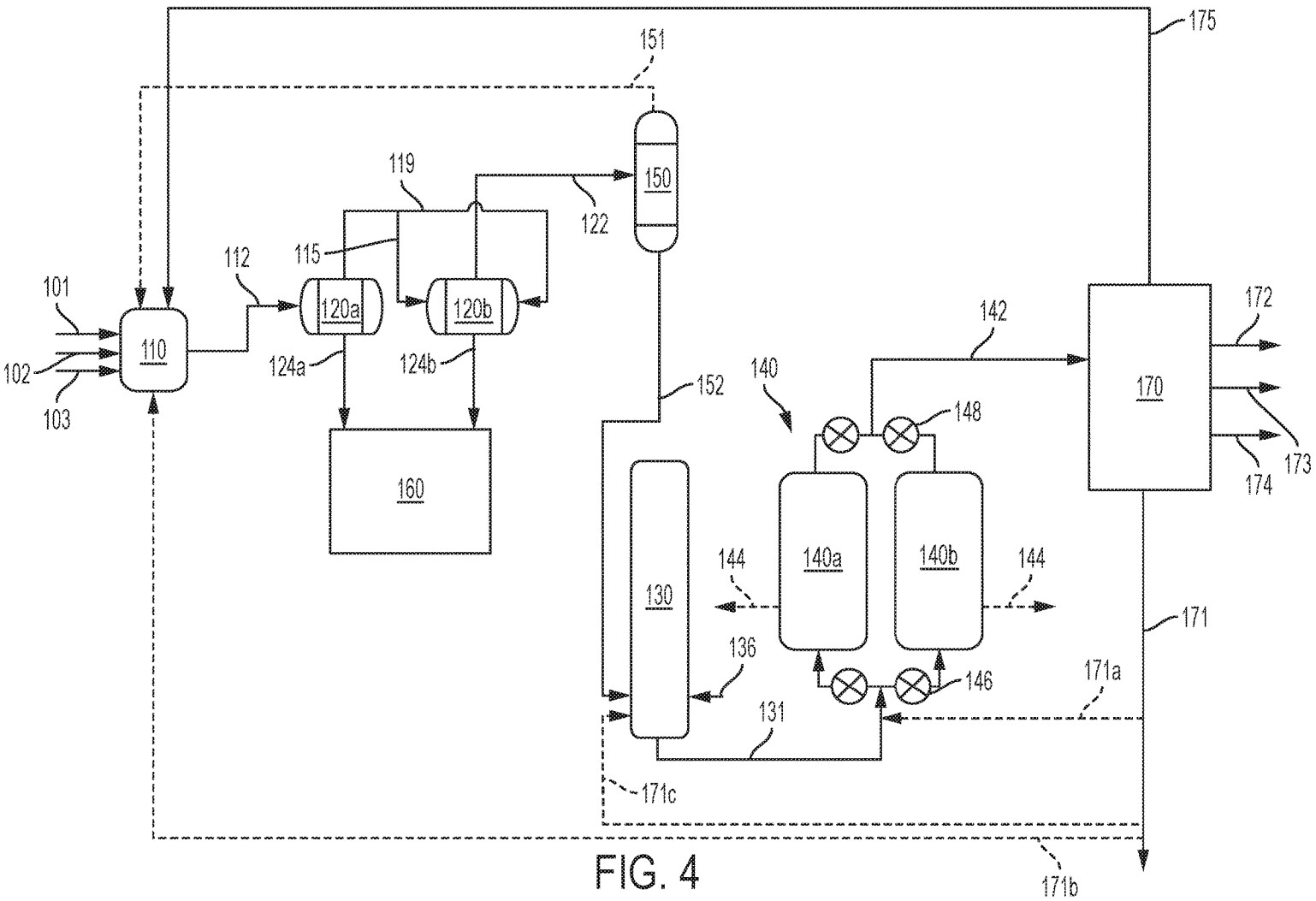
FIG. 4 is another schematic depiction of solvent deasphalting unit with mixed solvent feed upstream of a separator, a hydrotreater, and delayed coker in accordance with one or more embodiments of the present disclosure.

Referring to the embodiment of FIG. 4, at least one separator and stripper unit 150 may be included downstream of the solvent deasphalting unit 120. As shown, the separator and stripper unit 150 may remove solvent 151 from the DAO fraction 122 and recycle the solvent 151 back to the solvent deasphalting unit 120. The DAO fraction after solvent separation 152 may be fed to the delayed coker 140 for the production of green coke.

As shown in FIGS. 1-4, the delayed coker 140 may include at least two parallel drums 140*a*, 140*b*, which are operated in a swing mode. When one coke drum is full of coke, the feed is switched to a fresh empty drum, and the full drum is cooled. As shown, inlet valves 146 and outlet valves 148 may control flow in and out of the delayed coker 140. The coke remaining in the drums is typically cooled with water and then removed from the coke drum by conventional methods, for example, using hydraulic or mechanical techniques, or both, to dislodge the solid coke from the drum walls for recovery. The green coke 144 in drums 140*a*, 140*b* may be calcined to produce high quality coke. Various operating parameters are considered suitable for the delayed coker 140. For example, the temperature may range from 440 to 530° C., and the pressure may range from 1 to 5 bars.

In addition to producing green coke 144, the delayed coker drums 140*a*, 140*b* also discharges delayed coker effluent 142, for example, distillates and gases, which are produced during the delayed coking process. Referring to FIGS. 1-4, the fractionator 170 comprises an inlet in fluid communication with the delayed coker effluent 142. The fractionator 170 also has a series of outlet ports for separating and discharging heavy naphtha 172, light coker gas oil 173, and heavy coker gas oil 174. Fractionator 170 also has an outlet for discharging solvent and light naphtha 175 that is optionally recycled back to the mixing vessel 110, to the hydrotreater unit 130, or both. The light naphtha stream comprises a mixture of alkanes and alkenes, whereas the solvent to be recycled includes the paraffinic and aromatic solvents fed to the solvent deasphalting unit 120. Without being limited by operating parameters, the solvent and light naphtha 175 may have a final boiling point of up to 100° C. In one embodiment, the fractionator 170 may also discharge unconverted bottoms oil 171 through a bottom port. In another embodiment, at least a portion of this unconverted bottoms oil 171 is recycled to the delayed coker 140 through recycle stream 171*a*. In yet another embodiment, at least a portion of this unconverted bottoms oil 171 is recycled to the mixing vessel 110 through recycle stream 171*b*. In a further embodiment, at least a portion of this unconverted bottoms oil 171 is recycled to the hydrotreater unit 130 through recycle stream 171*c*. While not shown, light gases may be separated from the distillates in a flash unit downstream of the delayed coker 140 but upstream of the fractionator 170.

Figure 2:
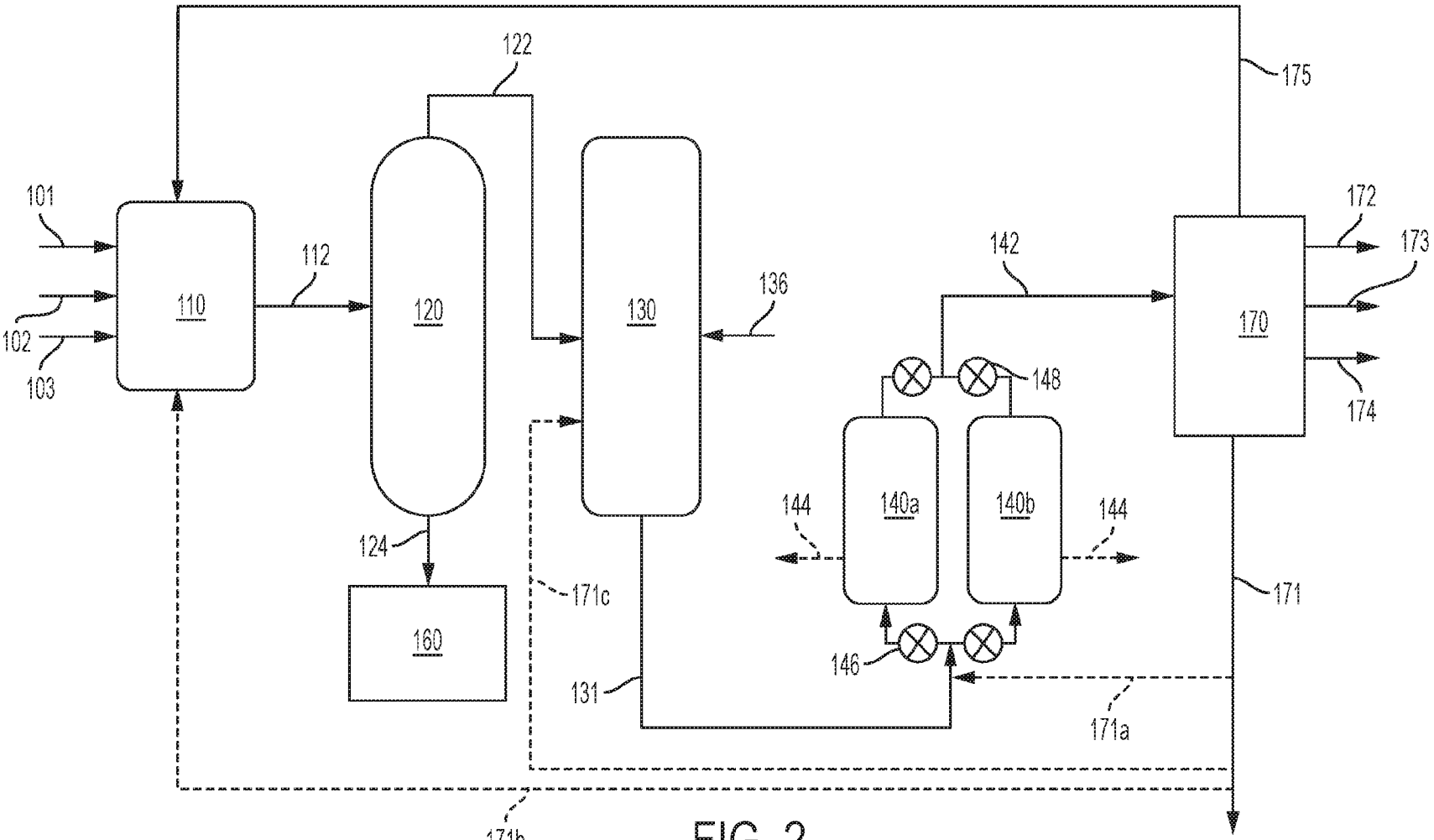
FIG. 2 is a schematic depiction of a solvent deasphalting unit with mixed solvent feed upstream of a hydrotreater and delayed coker in accordance with one or more embodiments of the present disclosure.

Referring to FIGS. 2-4, the DAO fraction 122 may be passed to a hydrotreater unit 130 to remove sulfur, metals, and nitrogen from the DAO fraction 122 and thereby produce a hydrotreated DAO fraction 131 upstream of the delayed coker 140. The hydrotreated DAO fraction 131 may then be passed to a delayed coker 140 to produce green coke 144 and the delayed coker effluent 142.

Various hydrotreating processes and components are considered suitable, with extensive variation in the parameters being possible. That being said, when these hydrotreating units (also called hydrocracking units) are operated under high severity conditions, the cost of operating these units may be costly. Without being limited by theory, the present mixed solvent deasphalting may enable the hydrotreater unit 130 to run at lesser severity conditions, which consequently are less costly, while still achieving green coke in the delayed coker 140. In one or more embodiments, the temperature may be from 300 to 450° C., or from 340 to 400° C., whereas the hydrogen partial pressure may vary from 20-150 bar, or from 60 to 100 bar. These pressures are consistent with low severity hydrotreating, and contrast high severity hydrotreating which includes hydrogen partial pressures greater than 150 bars. The LHSV may be from 0.5 to 10 $h^{-1}$, or from 1 to 2 $h^{-1}$, and the ratio of hydrogen/DAO fraction may be from 100 to 5000 standard liters per liter, or 100 to 1500 standard liters per liter. Moreover, the parameters may be varied based on the type of high grade coke desired. For example, if needle coke is the desired product, the hydrotreater unit 130 may need to run at higher temperatures or pressures, because needle coke has higher purity requirements than anode coke.

For example and not by way of limitation, the hydrotreater unit 130 may include fixed bed reactors, ebullated-bed reactors, moving bed reactors, slurry bed reactors or combinations thereof. In a fixed bed reactor, catalyst particles are stationary and do not move with respect to a fixed reference frame. Due to exothermic nature of the reactions, a fixed-bed reactor may have multiple catalysts bed and the effluents are quenched between the beds. Multiple fixed-bed reactors connected in series can be used to achieve a relatively high conversion of heavy feedstocks boiling at a cut point in the range of 300 to 500° C. An ebullated-bed reactor includes concurrently flowing streams of liquids or slurries of liquids, solids and gas, through a vertically oriented cylindrical vessel containing catalyst. The catalyst is placed in motion in the liquid and has a gross volume dispersed through the liquid medium that is greater than the volume of the mass when stationary. In an ebullated-bed reactor, the catalyst is in an expanded bed, thereby countering plugging potential problems associated with fixed-bed reactors. The fluidized nature of the catalyst in an ebullated-bed reactor also allows for on-line catalyst replacement of a small portion of the bed. This results in a high net bed activity which does not vary with time. In addition, the ebullated-bed reactors are operated in isothermal mode of operation because of back-mixed characteristics of the system. The feed temperature is adjusted to quench the heat generated in the ebullated-bed reactor. Moving-bed reactors combine certain advantages of fixed-bed operations and the relatively easy catalyst replacement of ebullated-bed technology Catalysts employed in the hydrotreater unit 130 may include components capable of facilitating the desired removal and conversion of contaminants in the DAO fraction. These catalysts may include supported active metal catalysts, where the active metals may include cobalt, nickel, tungsten, molybdenum or combinations thereof. The support material may be selected from the group consisting of alumina, silica-alumina, titania, titania-silicalite, silica, and zeolites or combination thereof.

While not shown, various additional treatment units may be included in the previously described embodiments. For example, one or more adsorption columns (not shown) may be disposed upstream of the delayed coker to desulfurize and demetallize the DAO fraction. The adsorption columns may include various adsorbent materials. These materials may be in packaged or slurry form and may include, but are not limited to, attapulgus clay, zeolites, alumina, silica gel, silica-titania, silica-alumina, spent or regenerated catalysts from other refinery operations, as well as activated carbon. In further embodiments, the adsorption columns may include one or more packed bed reactors.

EXAMPLES

The following examples illustrate two different embodiments. Referring to FIG. 1 for illustration, Example 1 is a mixed solvent deasphalting system which produces green coke in the delayed coker 140 without a hydrotreater 130 between the solvent deasphalting unit 120 and the delayed coker 140. In contrast, the system of Example 2 illustrated in FIG. 3 utilizes a hydrotreater 130 between the solvent deasphalting unit 120 and the delayed coker 140 to produce green coke.

Example 1

TABLE 2

Operating Conditions for Example 1

| Operating Conditions | Solvent Deasphalting Unit (120) | Delayed Coker (140) |
|---|---|---|
| Temperature (° C.) | 70 | 490 |
| Pressure (Bars) | 40 | 3 |
| Solvents | Heptane and Toluene | NA |
| Paraffinic Solvent/Oil Ratio | 7 | NA |

TABLE 3

Material Balance for Example 1

| | Stream# | | | | | | |
|---|---|---|---|---|---|---|---|
| | 101 | 102 | 103 | 122 | 124 | 142 | 144 |
| Stream Name | Residual Oil | Heptane | Toluene | DAO | Asphalt | Distillates + Gas | Green Coke |
| Feed/Product Rate (Kg) | 1000.0 | 7000 | 210.0 | 950 | 50 | — | 104.9 |
| Density (Kg/L) | 0.939 | 0.684 | 0.933 | — | 1.019 | 1.181 | — |
| API Gr. (°) | 19.19 | — | 20.2 | — | 7.4 | — | — |
| Sulfur (wt %) | 2.281 | — | — | 2.24 | 3.15 | — | 3.35 |
| Nitrogen (Ppmw) | 0 | — | — | — | — | — | — |
| MCR (wt %) | 6.9 | — | — | 6.1 | 22.6 | — | — |
| Nickel (Ppmw) | 4 | — | — | 0 | 80 | — | 37 |
| Vanadium (Ppmw) | 7 | — | — | 5 | 40 | — | 51 |

Example 2

TABLE 4

Operating Conditions for Example 2

| Operating Conditions | Solvent deasphalting Unit (120) | Hydrotreater (130) | Delayed Coker (140) |
|---|---|---|---|
| Temperature (° C.) | 200 | 380 | 490 |
| Pressure (Bars) | 30 | 117 | 3 |
| LHSV ($h^{-1}$) | NA | 0.435 | NA |
| $H_2$/Oil Ratio | NA | 1250 | NA |
| Solvents | Heptane and Toluene | NA | NA |
| Paraffinic Solvent/ Oil Ratio | 7 | NA | NA |

TABLE 5

Material Balance for Example 2

| | Stream# | | | | | | | | |
|---|---|---|---|---|---|---|---|---|---|
| | 101 | 102 | 103 | 122 | 124 | 142 | 136 | 131 | 144 |
| Stream Name | Residual Oil | Heptane | Toluene | DAO | Asphalt | Distillates + Gas | $H_2$ | Hydrotreated DAO | Anode Grade Coke |

TABLE 5-continued

| Material Balance for Example 2 | | | | | | | | | |
|---|---|---|---|---|---|---|---|---|---|
| | Stream# | | | | | | | | |
| | 101 | 102 | 103 | 122 | 124 | 142 | 136 | 131 | 144 |
| Feed/ Product Rate (Kg) | 1000.0 | 7000 | 540.0 | 950 | 48 | 731 | 15.2 | 771.6 | 105.0 |
| Density (Kg/L) | 0.982 | 0.684 | 0.924 | — | 1.003 | 1.141 | — | — | — |
| API Gr. (°) | 12.59 | — | 21.6 | — | 5.3 | — | — | — | — |
| Sulfur (wt %) | 4.05 | — | — | 4.0 | 5.6 | — | — | 2.0 | 3.0 |
| Nitrogen (Ppmw) | 2900 | — | — | — | — | — | — | — | — |
| MCR (wt %) | 16.4 | — | — | 13.1 | 78.7 | — | — | 3.3 | — |
| Nickel (Ppmw) | 19 | — | — | 14.3 | 109.3 | — | — | 1.0 | 49.8 |
| Vanadium (Ppmw) | 61 | — | — | 45.8 | 350.8 | — | — | 1.0 | 76 |

It should now be understood that the various aspects of the processes for producing green coke from residual oil are described and such aspects may be utilized in conjunction with various other aspects.

In a first aspect, the disclosure provides a process for producing green coke from residual oil. The process comprises introducing residual oil and a solvent mixture into a mixing vessel to produce a feed mixture. The solvent mixture comprises at least one paraffinic solvent with a carbon number from 3 to 8 and at least one aromatic solvent. Further, the solvent mixture comprises from 0.1 to 10% by volume of aromatic solvent and 90 to 99.9% by volume of paraffinic solvent. The process also comprises passing the feed mixture to a solvent deasphalting unit to produce a deasphalted oil (DAO) fraction and an asphalt fraction and passing the DAO fraction to a delayed coker to produce the green coke and a delayed coker effluent.

In a second aspect, the disclosure provides a process for producing green coke from residual oil. The process comprises introducing residual oil and a solvent mixture into a mixing vessel to produce a feed mixture. The solvent mixture comprises at least one paraffinic solvent with a carbon number from 3 to 8 and at least one aromatic solvent. The process also comprises passing the feed mixture to a solvent deasphalting unit to produce a deasphalted oil (DAO) fraction and an asphalt fraction, passing the DAO fraction to a hydrotreater unit to produce a hydrotreated DAO fraction, and passing the hydrotreated DAO fraction to a delayed coker to produce the high quality coke and a delayed coker effluent.

In a third aspect, the disclosure provides the process of the first or second aspects, in which the process further comprises passing the delayed coker effluent to a fractionator unit. The fractionator unit separates the delayed coker effluent into separate fractionater output streams comprising: solvent and light naphtha, heavy naphtha, light coker gas oil, heavy coker gas oil, and unconverted bottoms oil.

In a fourth aspect, the disclosure provides the process of the third aspect, in which the light naphtha comprises a mixture of alkanes and alkenes.

In a fifth aspect, the disclosure provides the process of the third or fourth aspects, in which the process further comprises recycling the solvent and light naphtha back to the mixing vessel.

In a sixth aspect, the disclosure provides the process of any of the third through fifth aspects, in which the solvent has a final boiling point of up to 100° C.

In a seventh aspect, the disclosure provides the process of any of the third through sixth aspects, in which the process further comprises recycling the unconverted bottoms oil back to the mixing vessel.

In an eighth aspect, the disclosure provides the process of the second aspect, in which the process further comprises recycling the unconverted bottoms oil back to the hydrotreater unit.

In a ninth aspect, the disclosure provides the process of any of the third through eighth aspects, in which the process further comprises recycling the unconverted bottoms oil back to the delayed coker.

In a tenth aspect, the disclosure provides the process of any of the first through ninth aspects, in which the process further comprises subjecting the asphalt fraction to asphalt utilization and conversion steps.

In an eleventh aspect, the disclosure provides the process of the tenth aspect, in which the asphalt utilization and conversion steps includes include gasification, delivery to an asphalt pool, pyrolysis or combinations thereof.

In a twelfth aspect, the disclosure provides the process of any of the first through eleventh aspects, in which the process further comprises a separator and stripper downstream of the solvent deasphalting unit.

In a thirteenth aspect, the disclosure provides the process of any of the first through twelfth aspects, in which the solvent deasphalting unit comprises a first settler tank and a second settler tank downstream of the first settler tank.

In a fourteenth aspect, the disclosure provides the process of the thirteenth aspect, in which the first settler tank converts the feed mixture into an intermediate DAO fraction and a first asphalt fraction.

In a fifteenth aspect, the disclosure provides the process of the thirteenth or fourteenth aspects, in which the second settler tank converts the intermediate DAO fraction to a second asphalt fraction and the DAO fraction.

In a sixteenth aspect, the disclosure provides the process of any of the first through fifteenth aspects, in which the delayed coker comprises dual delayed coking drums.

In a seventeenth aspect, the disclosure provides the process of any of the first through sixteenth aspects, in which the aromatic solvents comprise a single ring aromatic compound.

In an eighteenth aspect, the disclosure provides the process of any of the first through seventeenth aspects, in which the aromatic solvents comprise benzene, toluene, or combinations thereof.

In a nineteenth aspect, the disclosure provides the process of any of the first through eighteenth aspects, in which the solvent mixture comprises at least one olefinic solvent.

In a twentieth aspect, the disclosure provides the process of any of the first through nineteenth aspects, in which the ratio of solvent mixture-to-residual oil in the feed mixture is from 0.1:1 to 10:1 by volume.

In a twenty-first aspect, the disclosure provides the process of the twentieth aspect, in which the ratio of solvent mixture-to-residual oil is from 2:1 to 10:1 by volume.

In a twenty-second aspect, the disclosure provides the process of any of the first through twenty-first aspects, in which the process further comprises calcining the green coke from the delayed coker to produce high quality coke.

In a twenty-third aspect, the disclosure provides the process of the twenty-second aspect, in which the high quality coke comprises anode coke, needle coke, or both.

In a twenty-fourth aspect, the disclosure provides the process of any of the first through twenty-third aspects, in which the solvent deasphalting unit operates at a temperature and pressure less than the supercritical temperature and pressure of the solvent mixture.

In a twenty-fifth aspect, the disclosure provides the process of any of the first through twenty-fourth aspects, in which the delayed coker operates at a temperature from 440° C. to 530° C. and a pressure from 1 to 5 Bars.

In a twenty-sixth aspect, the disclosure provides the process of any of the second through twenty-fifth aspects, in which the hydrotreater operates at a temperature of 300 to 450° C. and a hydrogen partial pressure of 20 to 150 bars.

In a twenty-seventh aspect, the disclosure provides the process of any of the first through twenty-sixth aspects, in which the aromatic solvents are polar solvents having a Hildebrand solubility parameter of at least 8.5.

It should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

Throughout this disclosure ranges are provided. It is envisioned that each discrete value encompassed by the ranges are also included. Additionally, the ranges which may be formed by each discrete value encompassed by the explicitly disclosed ranges are equally envisioned.

What is claimed is:

1. A process for producing green coke from residual oil comprising:

introducing residual oil and a solvent mixture into a mixing vessel to produce a feed mixture, the solvent mixture comprising at least one paraffinic solvent with a carbon number from 3 to 8 and at least one aromatic solvent, where the solvent mixture comprises from 0.1 to 10% by volume of aromatic solvent and 90 to 99.9% by volume of paraffinic solvent;

passing the feed mixture to a solvent deasphalting unit to produce a deasphalted oil (DAO) fraction and an asphalt fraction; and passing the DAO fraction to a delayed coker to produce the green coke and a delayed coker effluent.

2. The process of claim 1, further comprising passing the delayed coker effluent to a fractionator unit, where the fractionator unit separates the delayed coker effluent into separate fractionater output streams comprising: solvent and light naphtha; heavy naphtha; light coker gas oil; heavy coker gas oil; and unconverted bottoms oil.

3. The process of claim 2, further comprising recycling the solvent and light naphtha back to the mixing vessel.

4. The process of claim 2, where the solvent has a final boiling point of up to 100° C.

5. The process of claim 2, further comprising recycling the unconverted bottoms oil back to one or more of the mixing vessel and the delayed coker.

6. The process of claim 1, further comprising subjecting the asphalt fraction to asphalt utilization and conversion steps.

7. The process of claim 6, where the asphalt utilization and conversion steps includes include gasification, delivery to an asphalt pool, pyrolysis or combinations thereof.

8. The process of claim 1, further comprising a separator and stripper downstream of the solvent deasphalting unit.

9. The process of claim 1, where the solvent deasphalting unit comprises a first settler tank and a second settler tank downstream of the first settler tank.

10. The process of claim 9, where the first settler tank converts the feed mixture into an intermediate DAO fraction and a first asphalt fraction.

11. The process of claim 9, where the second settler tank converts the intermediate DAO fraction to a second asphalt fraction and the DAO fraction.

12. The process of claim 1, where the delayed coker comprises dual delayed coking drums.

13. The process of claim 1, where the aromatic solvents comprise a single ring aromatic compound.

14. The process of claim 1, where the solvent mixture comprises at least one olefinic solvent.

15. The process of claim 1, where the ratio of solvent mixture-to-residual oil in the feed mixture is from 0.1:1 to 10:1 by volume.

16. The process of claim 15, where the ratio of solvent mixture-to-residual oil is from 2:1 to 10:1 by volume.

17. The process of claim 1, further comprising calcining the green coke from the delayed coker to produce high quality coke.

18. The process of claim 1, where the solvent deasphalting unit operates at a temperature and pressure less than the supercritical temperature and pressure of the solvent mixture.

19. The process of claim 1, where the aromatic solvents are polar solvents having a Hildebrand solubility parameter of at least 8.5.

20. A process for producing green coke from residual oil comprising:

introducing residual oil and a solvent mixture into a mixing vessel to produce a feed mixture, the solvent mixture comprising at least one paraffinic solvent with a carbon number from 3 to 8 and at least one aromatic solvent;

passing the feed mixture to a solvent deasphalting unit to produce a deasphalted oil (DAO) fraction and an asphalt fraction;

passing the DAO fraction to a hydrotreater unit to produce a hydrotreated DAO fraction; and passing the hydrotreated DAO fraction to a delayed coker to produce the high quality coke and a delayed coker effluent.

* * * * *